US010271136B2

(12) United States Patent
Tao et al.

(10) Patent No.: US 10,271,136 B2
(45) Date of Patent: Apr. 23, 2019

(54) AUDIO ENHANCEMENT IN MOBILE COMPUTING

(71) Applicants: Intel Corporation, Santa Clara, CA (US); Jiancheng Tao, Shanghai (CN); Hong W. Wong, Portland, OR (US); Devon Worrell, Folsom, CA (US); Wah Yiu Kwong, Hillsboro, OR (US); Jian Wang, Shanghai (CN)

(72) Inventors: Jiancheng Tao, Shanghai (CN); Hong W. Wong, Portland, OR (US); Devon Worrell, Folsom, CA (US); Wah Yiu Kwong, Hillsboro, OR (US); Jian Wang, Shanghai (CN)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/119,101

(22) PCT Filed: Apr. 1, 2014

(86) PCT No.: PCT/CN2014/074527
§ 371 (c)(1),
(2) Date: Aug. 15, 2016

(87) PCT Pub. No.: WO2015/149276
PCT Pub. Date: Oct. 8, 2015

(65) Prior Publication Data
US 2017/0055074 A1 Feb. 23, 2017

(51) Int. Cl.
*H04R 1/22* (2006.01)
*H04R 1/24* (2006.01)
(Continued)

(52) U.S. Cl.
CPC ..... *H04R 3/002* (2013.01); *H04R 1/22* (2013.01); *H04R 1/24* (2013.01); *H04R 3/12* (2013.01);
(Continued)

(58) Field of Classification Search
CPC H04R 2499/15; H04R 17/00; H04R 2499/11; H04R 7/045
(Continued)

(56) References Cited

U.S. PATENT DOCUMENTS 8,638,953 B2 1/2014 Jonsson et al.
2002/0068532 A1* 6/2002 Wong ..... H04M 1/0216 455/575.1
(Continued)

FOREIGN PATENT DOCUMENTS

CN 102348146 2/2012
CN 102428713 4/2012
WO WO 2012177572 12/2012

OTHER PUBLICATIONS

International Search Report and Written Opinion in International Patent Application No. PCT/CN2014/074527 dated Jan. 6, 2015.

*Primary Examiner* — Alexander Jamal
(74) *Attorney, Agent, or Firm* — Patent Capital Group

(57) ABSTRACT

In an example, a mobile computing device is provided with mechanical driver s for enhancing audio output, including low-frequency audio. The mechanical drivers may be provided to supplement traditional speakers. In an embodiment, mechanical drivers are boosted in effectiveness by being disposed against a sturdy surface such as a desktop. When a user holds a convertible tablet up, such enhancement may be provided by enabling mechanical drivers that are disposed against a base or other structural member of the convertible tablet.

27 Claims, 12 Drawing Sheets

(51) Int. Cl.
*H04R 3/00* (2006.01)
*H04R 9/06* (2006.01)
*H04R 3/12* (2006.01)

(52) U.S. Cl.
CPC ..... *H04R 9/066* (2013.01); *H04R 2499/11* (2013.01)

(58) Field of Classification Search
USPC ..... 381/333, 162, 182
See application file for complete search history.

(56) References Cited

U.S. PATENT DOCUMENTS

2005/0002537 A1* 1/2005 Azima ..... H04R 7/045 381/152
2006/0082518 A1* 4/2006 Ram ..... G06F 1/1601 345/1.1
2007/0223745 A1* 9/2007 Feng ..... H04M 1/04 381/160
2012/0082317 A1* 4/2012 Pance ..... H04R 7/045 381/59
2013/0185061 A1* 7/2013 Arvanaghi ..... G10K 11/175 704/201
2013/0194741 A1* 8/2013 Uchiyama ..... E05D 3/12 361/679.26
2014/0126761 A1* 5/2014 Pham ..... H04R 1/2811 381/353
2014/0131225 A1* 5/2014 Couch, III ..... A45C 11/00 206/45.24
2016/0192081 A1* 6/2016 Horii ..... H04M 1/03 379/420.02
2016/0202772 A1* 7/2016 Aurongzeb ..... G06F 3/041 345/173
2016/0212547 A1* 7/2016 Kang ..... B06B 1/045

* cited by examiner

AUDIO ENHANCEMENT IN MOBILE COMPUTING

This application is a national stage application under 35 U.S.C. § 371 of PCT International Application Serial No. PCT/CN2014/074527, filed on Apr. 1, 2014 and entitled "AUDIO ENHANCEMENT IN MOBILE COMPUTING", which application is considered part of and is hereby incorporated by reference in its entirely in the disclosure of this application.

FIELD OF THE DISCLOSURE

This application relates to the field of mobile computing, and more particularly to the use of mechanical drivers for enhancing audio outputs of mobile computing devices.

BACKGROUND

In an example, a mobile computing device is provided with mechanical drivers for enhancing audio output, including low-frequency audio. The mechanical drivers may be provided to supplement traditional speakers. In an embodiment, mechanical drivers are boosted in effectiveness by being disposed against a sturdy surface such as a desktop. When a user holds a convertible tablet up, such enhancement may be provided by enabling mechanical drivers that are disposed against a base or other structural member of the convertible tablet.

BRIEF DESCRIPTION OF THE DRAWINGS

The present disclosure is best understood from the following detailed description when read with the accompanying FIGURES. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION OF THE EMBODIMENTS OVERVIEW

Figure 1:
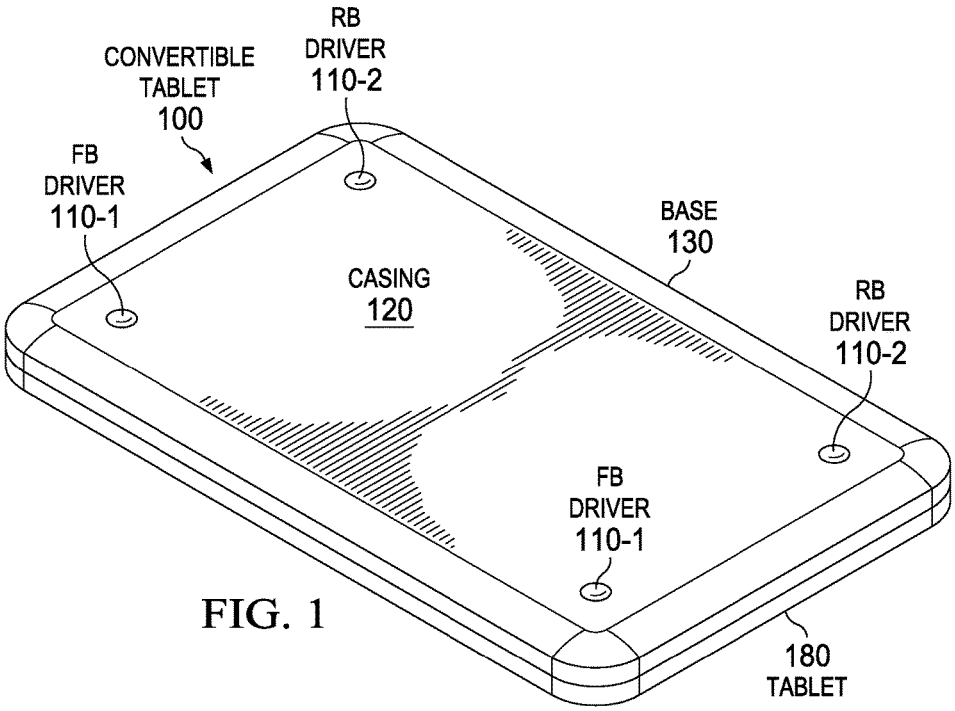
FIG. 1 is a perspective view of a convertible tablet according to one or more examples of the present specification.

In an example, a mobile computing device is provided with mechanical drivers for enhancing audio output, including low-frequency audio. The mechanical drivers may be provided to supplement traditional speakers. In an embodiment, mechanical drivers are boosted in effectiveness by being disposed against a sturdy surface, such as a desktop. When a user holds a convertible tablet up, such enhancement may be provided by enabling mechanical drivers that are disposed against a base or other structural member of the convertible tablet.

EXAMPLE EMBODIMENTS OF THE DISCLOSURE

The following disclosure provides many different embodiments, or examples, for implementing different features of the present disclosure. Specific examples of components and arrangements are described below to simplify the present disclosure. These are, of course, merely examples and are not intended to be limiting. Further, the present disclosure may repeat reference numerals and/or letters in the various examples. This repetition is for the purpose of simplicity and clarity and does not in itself dictate a relationship between the various embodiments and/or configurations discussed.

Different embodiments may have different advantages, and no particular advantage is necessarily required of any embodiment.

Reference is made to co-pending U.S. patent application Ser. No. 14/126,796, entitled "Augmenting Mobile Computing Device Audio Output Via Vibration Elements," filed 16 Dec. 2013, which is incorporated herein by reference in its entirety.

FIG. 1 is a bottom perspective view of a convertible tablet 100 according to one or more examples of the present Specification. It should be noted that convertible tablet 100 is provided as an example of a computing device according to this Specification, and it is not intended that convertible tablet 100 be limited specifically to a convertible tablet or to any other specific computing device. Rather it should be recognized that numerous types of computing devices are compatible with this Specification, and it is intended that the appended claims encompass all such computing devices unless specifically stated otherwise.

In an example, convertible tablet 100 includes a base 130 and a tablet 180. In certain embodiments, base 130 may be communicatively and mechanically coupled to tablet 180. However, the communicative and mechanical coupling need not be a permanent arrangement. For example, in many convertible tablets, base 130 is provided to extend the abilities and functionality of a tablet 180. Base 130 may provide, for example, additional peripherals such as a full-size keyboard, a trackpad, speakers, additional communication ports, and in some cases an interface for a docking station that may provide additional extended functionality. In some cases, base 130 may also extend the computing capacity of tablet 180 by providing additional memory and/or processing power. It is therefore intended that base 130 and tablet 180 be understood only as nonlimiting examples. It is intended, therefore, that tablet 180 and base 130 should be understood only as nonlimiting examples of a first housing and second housing respectively, and that either may provide any of a plurality of functions.

Base 130 may include a plurality of mechanical drivers 110, which may be disposed and arranged in one or more useful configurations. The configuration disclosed herein with specificity should be understood to be only one example arrangement, and other designs may incorporate other arrangements according to design parameters. In this example, mechanical drivers 110 are divided into front bottom drivers 110-1 and rear bottom drivers 110-2. By way of example, there are two front bottom drivers 110-1, and two rear bottom drivers 110-2. Mechanical drivers 110 may be disposed within a casing 120 that provides an external shell and structural support for convertible tablet 100. In one example, mechanical drivers 110 are disposed so as to protrude slightly from casing 120 so that when casing 120 is laid on a working surface, mechanical drivers 110 are in direct mechanical contact with the working surface.

Figure 1A:
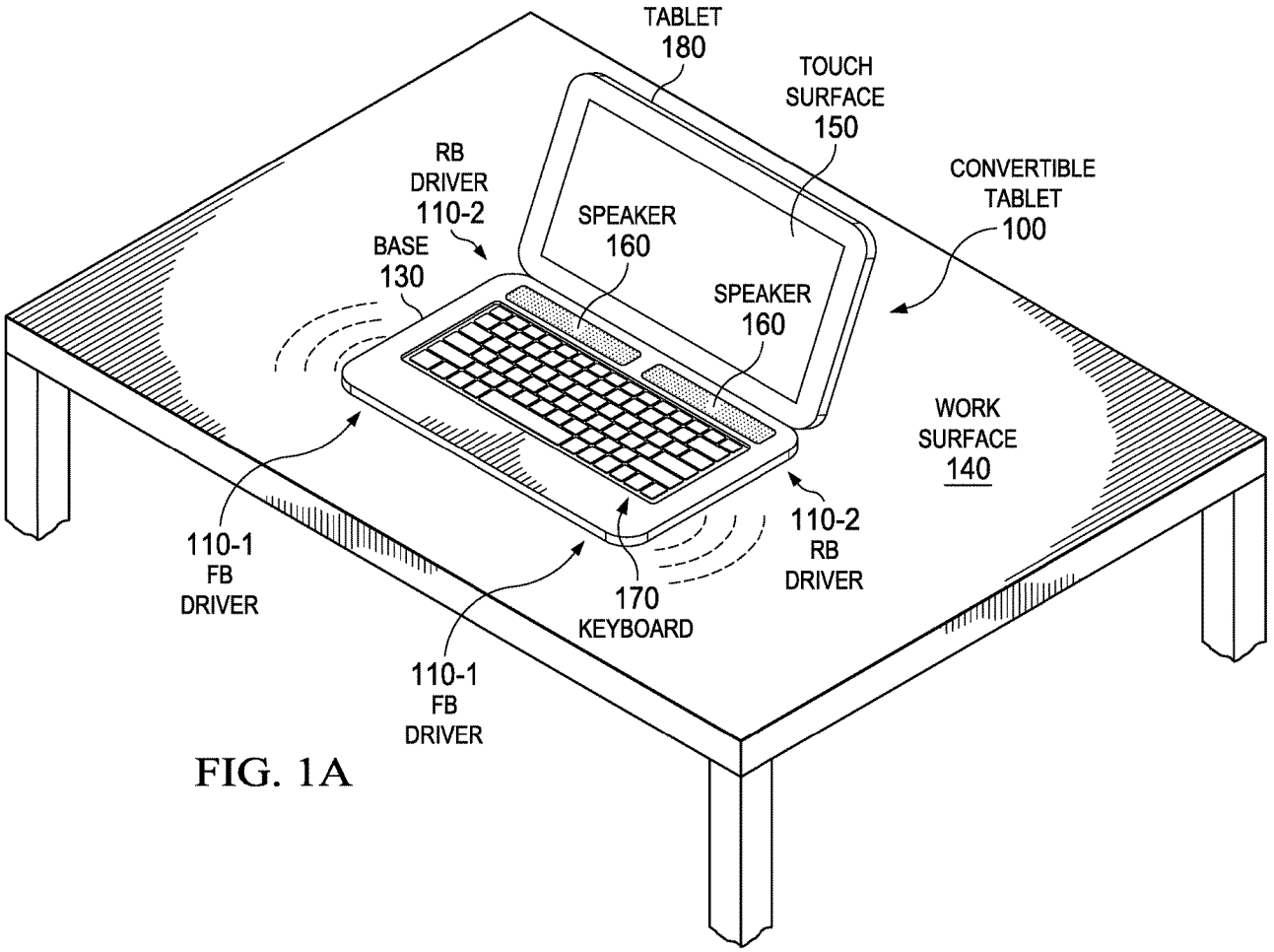
FIG. 1A is a perspective view of a convertible tablet according to one or more examples of the present specification.

This arrangement may be better understood with reference to FIG. 1A. In this example, convertible tablet 100 is placed on a work surface 140. Work surface 140 may be a table, desk, floor, or any other suitable surface. Work surface 140 may provide a rigid or semi rigid mechanical structure, and may act as a drive surface for mechanical drivers 110 to provide additional audio output. As is recognized in co-pending application Ser. No. 14/126,796, an expected form factor for convertible tablet 100 may result in speakers 160 that are thin and/or placed in sub-optimal positions. In the embodiment of FIG. 1A, speakers 160 are disposed atop base 130, but many other configurations are contemplated. For example, in certain embodiments, speakers 160 may be disposed on the bottom or sides of base 130, or along the edges of tablet 180. Such placements may in some cases be design expediencies, and it may not always be possible for a system designer to dispose speakers 160 in a position selected for optimal acoustical performance.

However, convertible tablet 100 may include pads or feet disposed, for example, along the bottom of base 130, and by provisioning mechanical drivers 110 within said pads or feet, the end user's audio experience may be enhanced when convertible tablet 100 is placed on work surface 140.

In one embodiment, mechanical drivers 110 may be selectively activated based on the usage context of convertible tablet 100, as described in more detail throughout this Specification. In certain embodiments, it may be advantageous to enable only some of a plurality of mechanical drivers 110.

When enabled, mechanical drivers 110 may be used to drive a mechanical waveform onto work surface 140. This mechanical waveform, in one embodiment, is a low frequency waveform, so that work surface 140 essentially becomes a supplemental bass speaker.

In the example of FIG. 1A, where convertible tablet 100 is resting on work surface 140 example, all four mechanical drivers 110 may be enabled and providing acoustic output. While mechanical drivers 110 are providing acoustic output, speakers 160 may also be providing audio output. Thus, mechanical drivers 110 may be used with speakers 160 to provide an overall augmented audio experience for the user. Further according to the embodiment of FIG. 1A, convertible tablet 100 may include a keyboard 170 disposed within base 130, which in an embodiment is disposed so that when convertible tablet 100 is in a closed position, touch surface 150 faces keyboard 170. In this example, mechanical drivers 110 are not visible, but rest between convertible tablet 100 and work surface 140.

Figure 2:
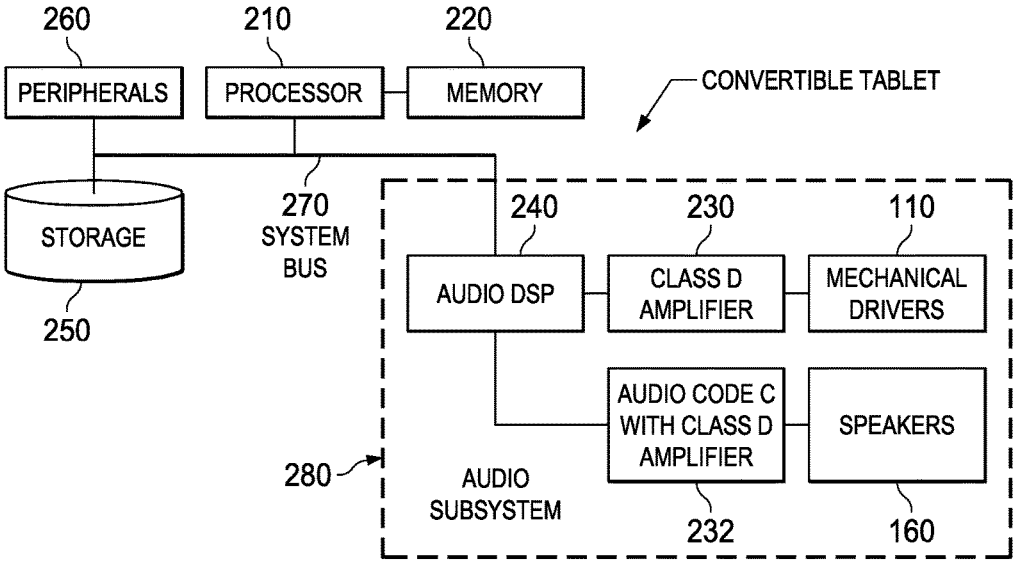
FIG. 2 is a block diagram of a convertible tablet according to one or more examples of the present specification.

FIG. 2 is a block diagram of a convertible tablet 100 according to one or more examples of the present Specification. It should be recognized that convertible tablet 100 is only one possible example of a computing device, and that in various embodiments, a "computing device" may be or comprise, by way of non-limiting example, a computer, embedded computer, embedded controller, embedded sensor, personal digital assistant (PDA), laptop computer, cellular telephone, IP telephone, smart phone, tablet computer, convertible tablet computer, handheld calculator, or any other electronic, microelectronic, or microelectromechanical device for processing and communicating data.

Convertible tablet 100 includes a processor 210 connected to a memory 220, having stored therein, by way of example, executable instructions for providing an operating system and an audio monitor daemon. Other components of convertible tablet 100 include a storage 250, peripherals 260, and audio subsystem 280.

In an example, processor 210 is communicatively coupled to memory 220 via a memory bus, which may be for example a direct memory access (DMA) bus. Processor 210 may be communicatively coupled to other devices via a system bus 270. As used throughout this Specification, a "bus" includes any wired or wireless interconnection line, network, connection, bundle, single bus, multiple buses, crossbar network, single-stage network, multistage network or other conduction medium operable to carry data, signals, or power between parts of a computing device, or between computing devices. It should be noted that these uses are disclosed by way of non-limiting example only, and that some embodiments may omit one or more of the foregoing buses, while others may employ additional or different buses. A power supply may distribute power to system devices via system bus 270, or via a separate power bus.

In various examples, a "processor" may include any combination of hardware, software, or firmware providing programmable logic, including by way of non-limiting example a microprocessor, digital signal processor, field-programmable gate array, programmable logic array, application-specific integrated circuit, or virtual machine processor.

Processor 210 may be connected to memory 220 in a DMA configuration via a DMA bus 270. To simplify this disclosure, memory 220 is disclosed as a single logical block, but in a physical embodiment may include one or more blocks of any suitable volatile or non-volatile memory technology or technologies, including for example DDR RAM, SRAM, DRAM, cache, L1 or L2 memory, on-chip memory, registers, flash, ROM, optical media, virtual memory regions, magnetic or tape memory, or similar. In certain embodiments, memory 220 may comprise a relatively low-latency volatile main memory, while storage 250 may comprise a relatively higher-latency non-volatile memory. However, memory 220 and storage 250 need not be physically separate devices, and in some examples may represent simply a logical separation of function. It should also be noted that although DMA is disclosed by way of non-limiting example, DMA is not the only protocol consistent with this Specification, and that other memory architectures are available.

Storage 250 may be any species of memory 220, or may be a separate device, such as a hard drive, solid-state drive, external storage, redundant array of independent disks (RAID), network-attached storage, optical storage, tape drive, backup system, cloud storage, or any combination of the foregoing. Storage 250 may be, or may include therein, a database or databases or data stored in other configurations, and may include a stored copy of operational software such as an operating system and a copy of the audio monitoring daemon. Many other configurations are also possible, and are intended to be encompassed within the broad scope of this Specification.

Figure 12:
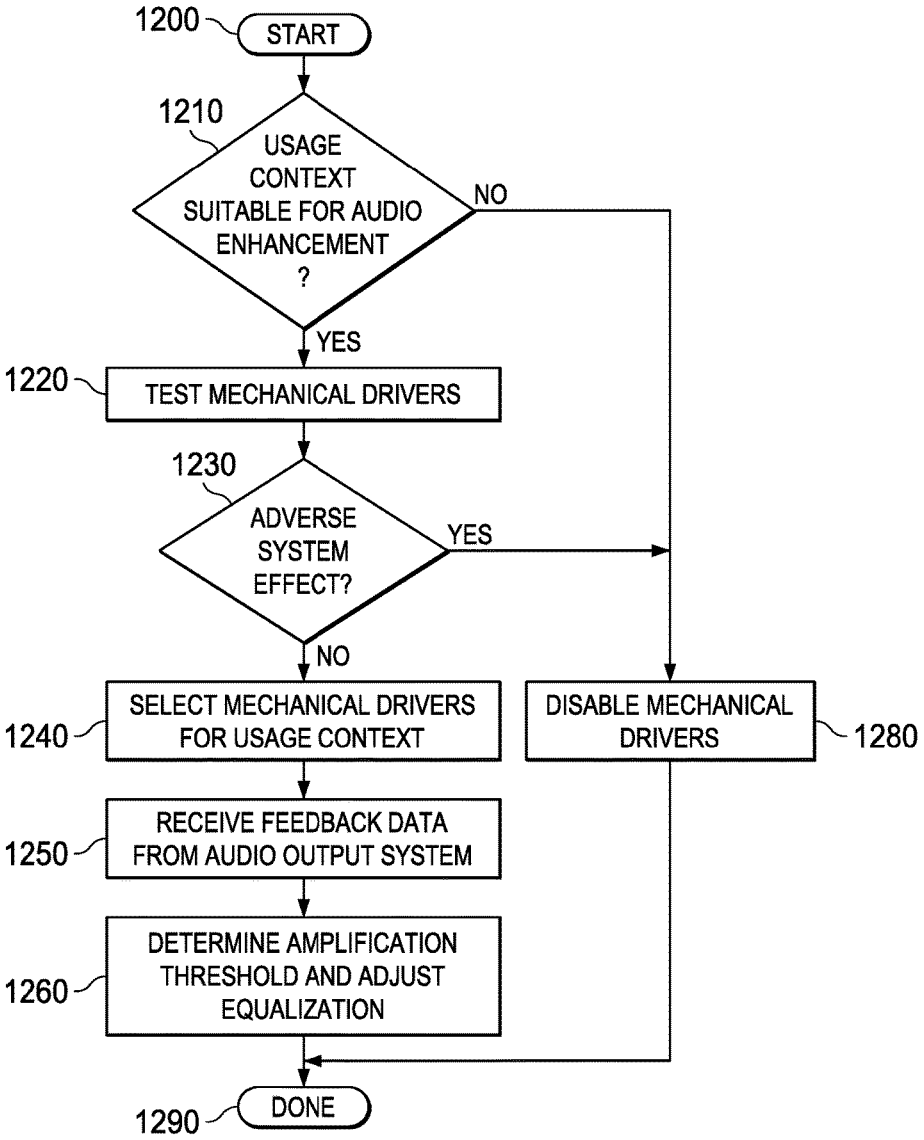
FIG. 12 is a flow diagram of a method according to one or more examples of the present specification.

In one example, the audio monitoring daemon is a utility or program that carries out a method, such as method 1200 of FIG. 12, or other methods according to this Specification. A "daemon" may include any program or series of executable instructions, whether implemented in hardware, software, firmware, or any combination thereof, which runs as a background process, a terminate-and-stay-resident program, a service, system extension, control panel, bootup procedure, BIOS subroutine, or any similar program that operates without direct user interaction. It should also be noted that an audio monitoring daemon is provided by way of non-limiting example only, and that other software, including interactive or user-mode software, may also be provided in conjunction with, in addition to, or instead of an audio monitoring daemon to perform methods according to this Specification.

In one example, an audio monitoring daemon includes executable instructions stored on a non-transitory medium operable to perform method 1200 of FIG. 12, or a similar method according to this Specification. At an appropriate time, such as upon booting convertible tablet 100 or upon a command from the operating system or a user, processor 210 may retrieve a copy of the audio monitoring daemon from storage 250 and load it into memory 220. Processor 210 may then iteratively execute the instructions an audio monitoring daemon.

Peripherals 260 include any auxiliary device that connects to convertible tablet 100 but that is not necessarily a part of the core architecture of convertible tablet 100. A peripheral may be operable to provide extended functionality to convertible tablet 100, and may or may not be wholly dependent on convertible tablet 100. In some cases, a peripheral may be a computing device in its own right. Peripherals may include input and output devices such as displays, terminals, printers, keyboards, mice, modems, network controllers, sensors, transducers, actuators, controllers, data acquisition buses, cameras, microphones, speakers, or external storage by way of non-limiting example.

Audio subsystem 280 may include, for example, an audio digital signal processing system (DSP) 240, a class D amplifier 230, an audio codec 232 with an amplifier such as a class-D amplifier, speakers 160, and mechanical drivers 110.

Audio amplifiers 230 and 232 may include, for example, variations of class A, class B or class AB amplifiers, which include power output transistors to function as linear regulators for modulating the output voltage of the amplifier. Class D amplifiers, utilized in this embodiment, function as switching amplifiers with the switches either fully on or off, thereby significantly reducing the power consumption of the amplifiers.

In one illustrative example, audio amplifiers 230 and 232 may operate by first converting audio data input received from audio DSP 240 into modulated digital signals, which are then amplified and filtered to recover an analog output signal. Thus, class D amplifiers utilized by embodiments of the present Specification may include an analog-to-digital converter coupled to provide a digital output to a modulator; the modulator's output is received by a filter, functioning as a digital-to-analog converter, and the filter's output is subsequently transmitted to the audio output components described below. In class D amplifiers, only the digital signal is amplified by on/off digital signal processing, thus, class D amplifiers can have very high power efficiency since they provide substantially full output power, while minimizing internal power consumption.

In one embodiment, audio codec and class D amplifier 232 is provided to output audio data to speakers 160, while class D amplifier 230 is provided to output acoustical waveforms to mechanical drivers 110 to augment the output of speakers 160, as described below. Audio codec and class D Amplifier 232 is illustrated as including an audio codec (i.e., audio coder/decoder). A codec may be used to convert digital audio data into an analog audio signal for playback by an audio device such as speakers 160. In some cases, an audio controller (not shown) may also provide an interface between the audio codec with class D amplifier 232 and audio DSP 240. In some embodiments, the audio controller may be included in a chipset of processor 210. In other embodiments, select components of audio subsystem 280 may be provided as a separate integrated circuit or daughter board, in which case audio subsystem 280 may provide its own audio controller. The audio controller may send and receive audio data streams to and from audio codec with class D amplifier 232 over a data link.

In this embodiment, mechanical drivers 110 work in combination with speakers 160 to output audio data processed from audio DSP 240. In computing devices such as mobile computing devices, a small form factor of the device is used to increase portability by reducing device volume and weight; however, this reduced form factor creates limited internal volume for speaker design. This limited speaker volume may result in poor sound quality, especially for lower frequency audio data, which typically is output via larger speaker components.

Embodiments of the present Specification may use mechanical drivers 110 to enhance the audio output of a computing device such as convertible tablet 100. Mechanical drivers 110 may comprise any conventional vibrating elements including a mass element (i.e., counterweight) electrically driven via an actuator to produce the vibrations. The weight/mass of the mass element/counterweight may be selected based on the desired strength and frequency for the vibration components (i.e., lower frequencies may utilize larger/heavier mechanisms).

Thus, audio DSP 240 may process audio data and separately output some of the data for speakers 160 (such as higher frequency audio data), and some of the data for mechanical drivers 110 (such as lower frequency audio data). Mechanical drivers 110 may be driven based on the audio data from audio DSP 240. For example, mechanical drivers 110 may comprise actuators to oscillate mass elements based on received waveform data, and the audio data may be used to change this waveform data (e.g., increase amplitude, peak duration, etc.).

Figure 3:
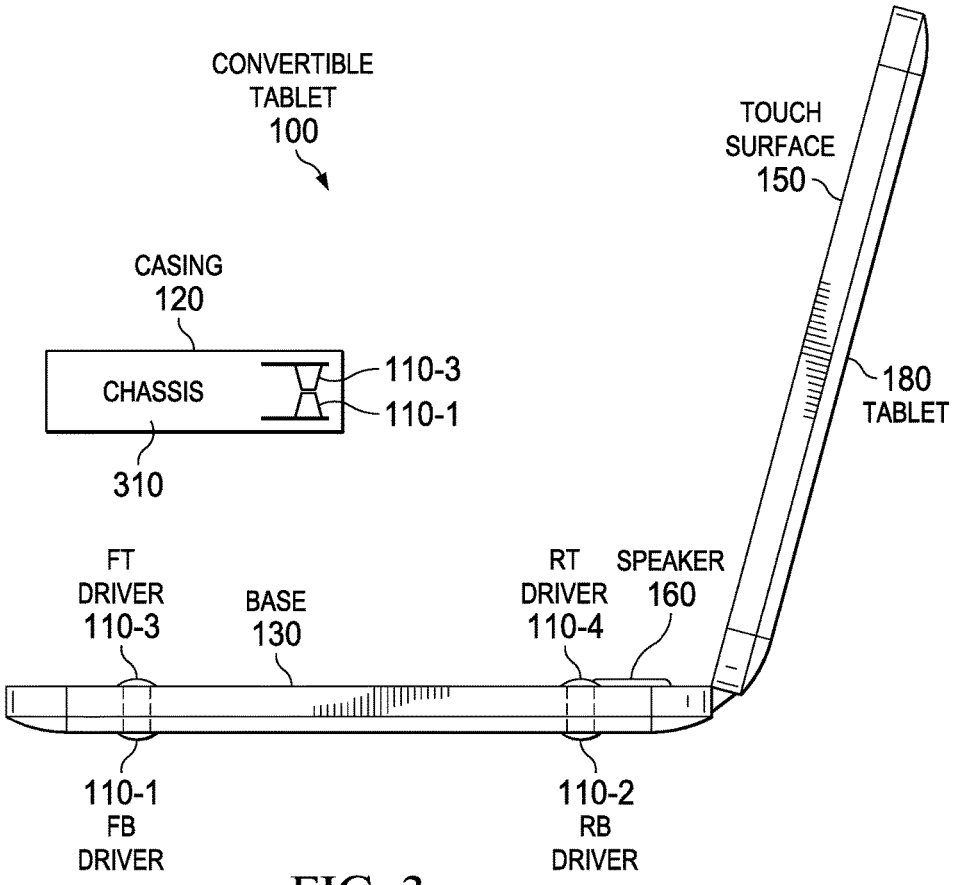
FIG. 3 is a side view of a convertible tablet according to one or more examples of the present specification.

FIG. 3 is a side view of convertible tablet 100 according to one or more examples of the present Specification. In this example, tablet 180 is disposed in an upward angled position from base 130, and touch surface 150 is on a face of tablet 180 facing inward toward base 130. As in previous examples, convertible tablet 100 includes speaker 160, and mechanical drivers 110. In this example, four species of mechanical drivers 110 are shown. Specifically, front bottom driver 110-1 and rear bottom driver 110-2 may be substantially similar to front bottom driver 110-1 and rear bottom driver 110-1 of the previous FIGURES. This FIGURE also includes a front top driver 110-3 and rear top driver 110-4. Each of the drivers shown in the present site view may have a matching mechanical driver 110 disposed on opposite side of casing 120. However, it should be recognized that mechanical drivers 110 need not necessarily be provided in pairs as described here. In some examples, mechanical drivers 110 may be provided singularly, in other configurations. For example, a single mechanical driver 110 could be provided that spans a full width of casing 120 spreading acoustic mass across a surface.

As shown in the detail of FIG. 3, casing 120 may provide a chassis 310 for supporting mechanical drivers 110. In some examples top and bottom pairings of mechanical drivers, such as front bottom driver 110-1 in front top driver 110-3 may be provided such that the two mechanical drivers 110 are disposed substantially one on top of the other. In this configuration, mechanical driver 110-3 may usefully and beneficially cancel feedback waveforms generated by mechanical driver 110-1 during operation, thus leaving only desirable waveforms. In that case, selecting mechanical driver 110-1 for operation may imply selection of mechanical driver 110-3 for operation as well, but in the capacity of an anti-feedback solution rather than as a driver for a user-perceptible output signal.

As will be appreciated according to this FIGURE, when convertible tablet 100 is used in the configuration shown, front bottom driver 110-1 and rear bottom driver 110-2 may be enabled, while front top driver 110-3 and rear top driver 110-4 may be disabled. This may be, for example, because bottom drivers 110-1 and 110-2 are provided with a mechanical surface such as work surface 140 of FIG. 1A to act as an acoustic mass. Front top drivers 110-3 and 110-4 do not have any such surface to drive an acoustic mass. Thus, the configuration of FIG. 3 may represent a first operating mode of mechanical drivers 110, wherein some of the plurality of mechanical drivers 110 are enabled while others of the plurality of mechanical drivers 110 are disabled. In one example, where mechanical drivers 110 are provided in pairings, each pairing is jointly enabled or disabled. For example, if there are two front bottom drivers 110-1, control logic may be provided to either jointly enable both front bottom drivers 110-1 or to jointly disable both front bottom drivers 110-1. Those with skill in the art will recognize that many other possible combinations are available.

It should also be recognized that the placement of and disposition of convertible tablet 100 in FIG. 3 is only one of many possible positions for convertible tablet 100.

Figure 4A:
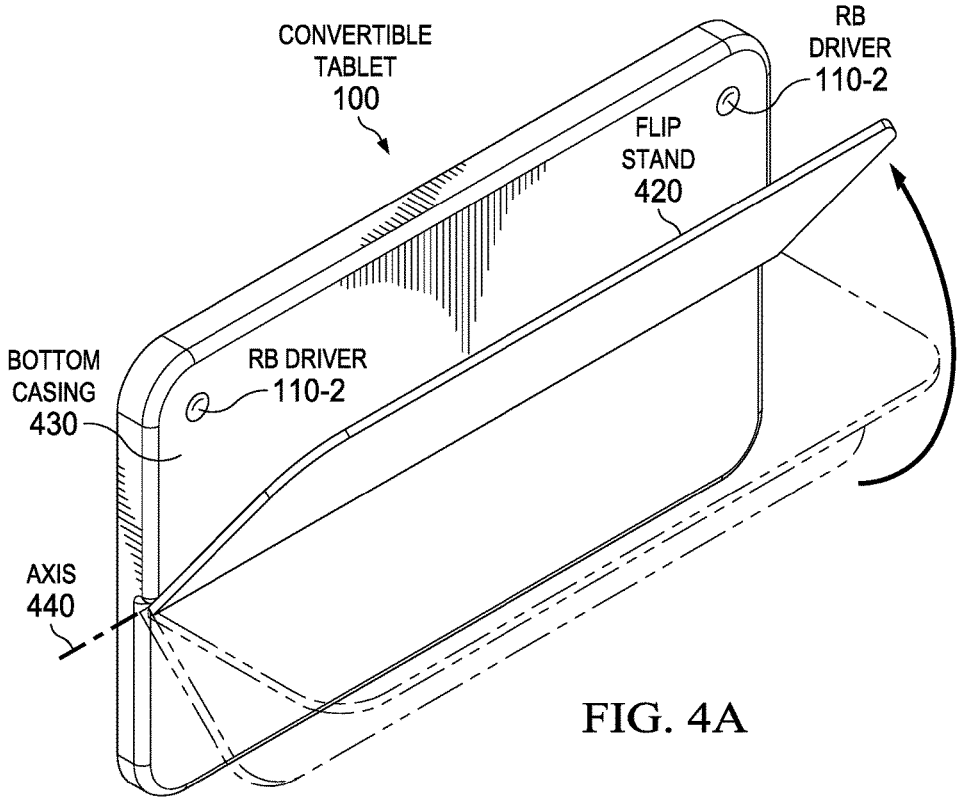
FIG. 4A is a rear perspective view of a convertible tablet according to one or more examples of the present specification.
Figure 4B:
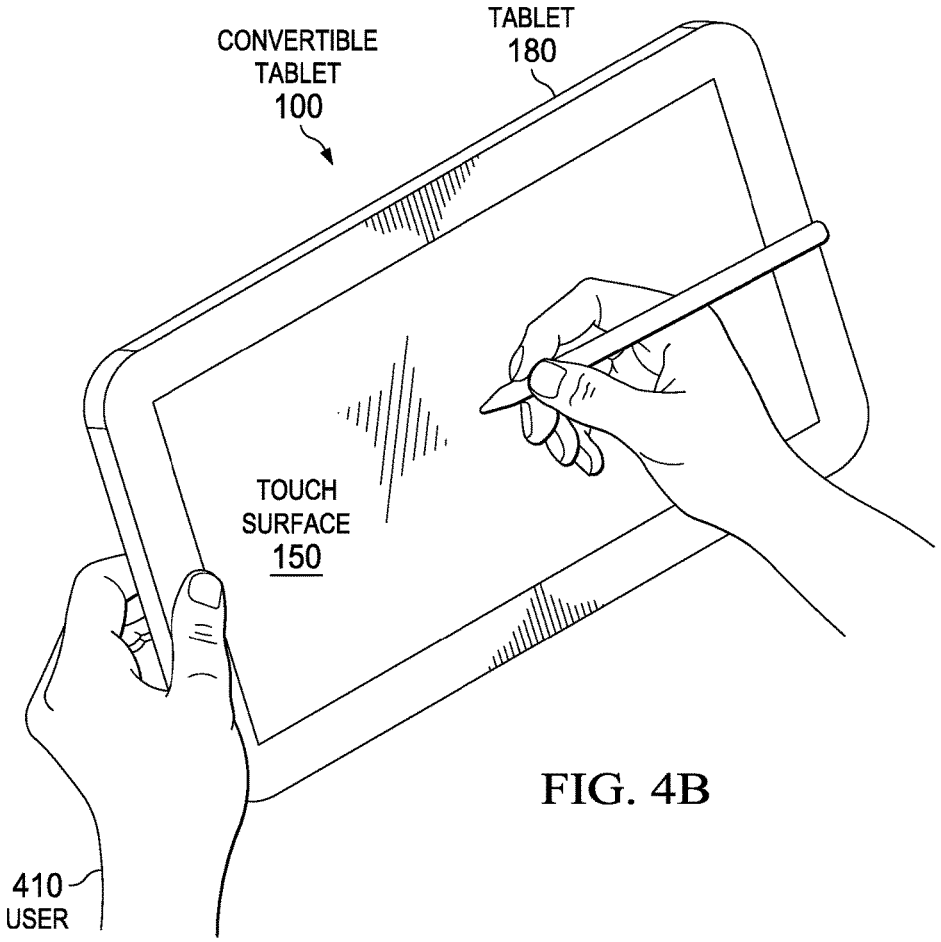
FIG. 4B is a perspective view of a user operating a convertible tablet according to one or more examples of the present specification.

FIGS. 4A and 4B disclosed another possible embodiment of convertible tablet 100. In this example, convertible tablet 100 is provided with a flip stand 420. In this example, flip stand 420 may be a solid panel, it may, for example, be made out of metal or molded plastic. Many other materials and configurations will be manifested, and are intended to be included within this Specification. Flip stand 420 may swivel on an axis 440, which allows flip stand 420 to rotate substantially downward into a position where it forms substantially an uninterrupted portion of bottom casing 430. However, as seen in FIG. 4B, a user 410 may elect to use convertible tablet 100 in some configuration other than lying flat on a work surface 140 of FIG. 1A. For example, flip stand 420 may be placed in an intermediate position, such that convertible tablet 100 may set on work surface 140 while user 410 interacts with convertible tablet 100. In this example, each of the mechanical drivers 110 may be disabled, as no mechanical driver has an acoustic master drive. However, as seen in FIG. 4B, user 410 may lift convertible tablet 100 and operate convertible tablet 100 in a handheld configuration. In this configuration, tablet 180 may be decoupled from base 130 if base 130 is provided. However, it should also be recognized, that tablet 180 may be provided without base 130, and in this configuration, convertible tablet 100 will include only tablet 180. It should be recognized that many other configurations are also possible.

However, in some cases, user 410 may wish to experience the augmented audio capabilities of using mechanical drivers 110 while operating convertible tablet 100 as a simple tablet 180. In that case, user 410 may keep convertible tablet 100 substantially in a fully upward position, so that flip stand 420 mechanically engages bottom casing 430. In that case, rear bottom drivers 110-2 are located on an drive surface to operate against, namely flip stand 420. Thus, in this configuration, rear bottom drivers 110-2 may be enabled, while all other mechanical drivers 110 are disabled. It should be recognized that many other similar configurations are possible.

Figure 5B:
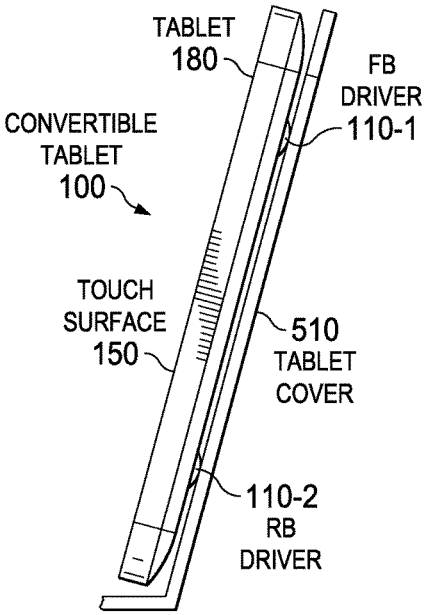
FIG. 5A is a front perspective view of a convertible tablet according to one or more examples of the present specification.
Figure 5A:
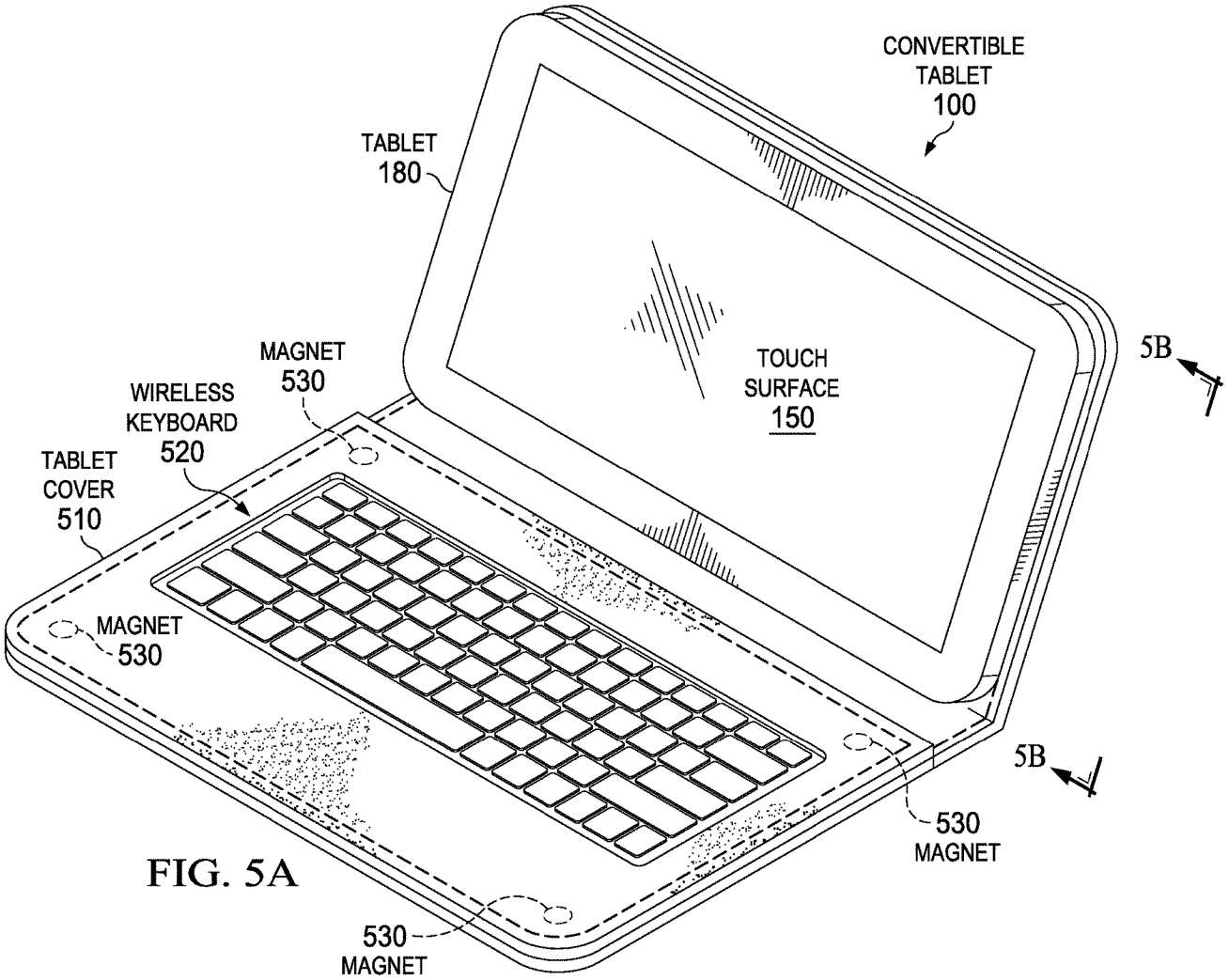

FIGS. 5A and 5B disclose yet another embodiment of a convertible tablet 100 according to one or more examples of the present Specification. Referring to the example in FIG. 5A, convertible tablet 100 includes a tablet 180 and base 130. In contrast with the embodiment of FIG. 1, the embodiment of FIG. 5A does not include a traditional base 130. Rather, in the embodiment of FIG. 5A, a separate tablet cover 510 is provided for holding tablet 180. In this example, tablet cover 510 may serve substantially the purpose of base 130. Tablet cover 510 may provide, for example, a wireless keyboard 520, which may communicatively couple to tablet 180 via a wireless protocol, such as Bluetooth. It should be recognized that Bluetooth is disclosed by way of example only, and that in other embodiments, wireless keyboard 520 may communicate with tablet 180 by many other means, including wired means. Thus, wireless keyboard 520 is disclosed as a Bluetooth keyboard by way of example only.

Also by way of example, tablet cover 510 may include a number of magnets 530 disposed substantially in the corners of tablet cover 510 to magnetically secure tablet cover 510 against tablet 180. This may help to protect touch surface 150.

In the example of FIG. 5A, mechanical drivers 110 may not be provided on base 130 as in the example of FIG. 1. Rather, mechanical drivers 110 may be provided on tablet 180.

Referring to FIG. 5B, in one operational mode, user 410 of FIG. 4 may fold tablet cover 510 around and place it behind tablet 180. In this configuration, if front and rear mechanical drivers 110-1 and 110-2 are provided on tablet 180 on a side opposite to touch surface 150, when tablet cover 510 may provide an acoustic mass for driving an acoustic signal. Thus, in the configuration of FIG. 5B, mechanical drivers 110-1 and 110-2 may be enabled and may provide a supplemental acoustic signal.

Figure 6:
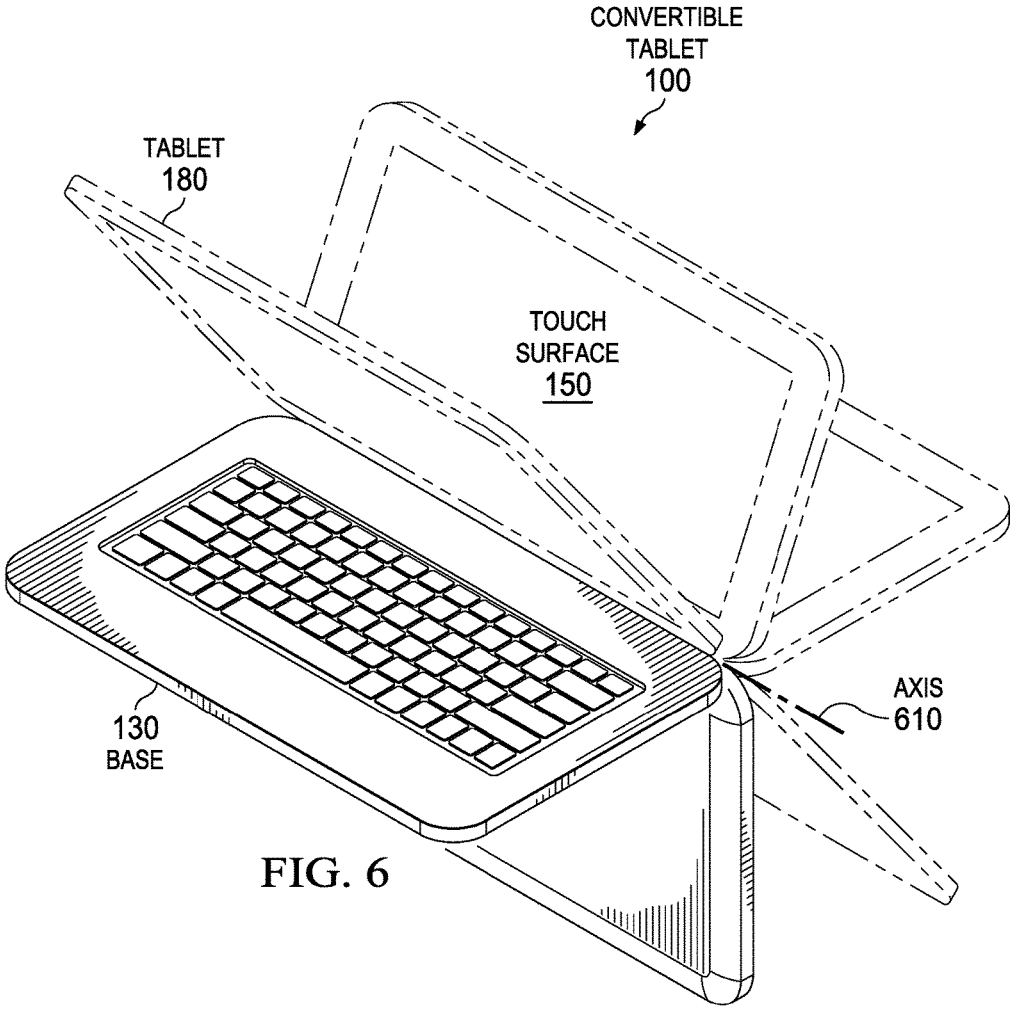
FIG. 6 is a perspective view of a convertible tablet according to one or more examples of the present specification.

FIG. 6 is a perspective view of a convertible tablet 100 according to one or more examples of the present Specification. In this embodiment, tablet 180 and base 130 may be provided as a single unit mechanically coupled, similar to the configuration of FIG. 1A. FIG. 6 discloses that in certain embodiments, tablet 180 may be operable to rotate substantially 160° around an axis 610. Thus, in an initial position, tablet 180 may be face down against base 130 thus protecting touch surface 150. When tablet 180 is rotated around substantially 360°, then base 130 and tablet 180 sit substantially back-to-back.

Figure 7:
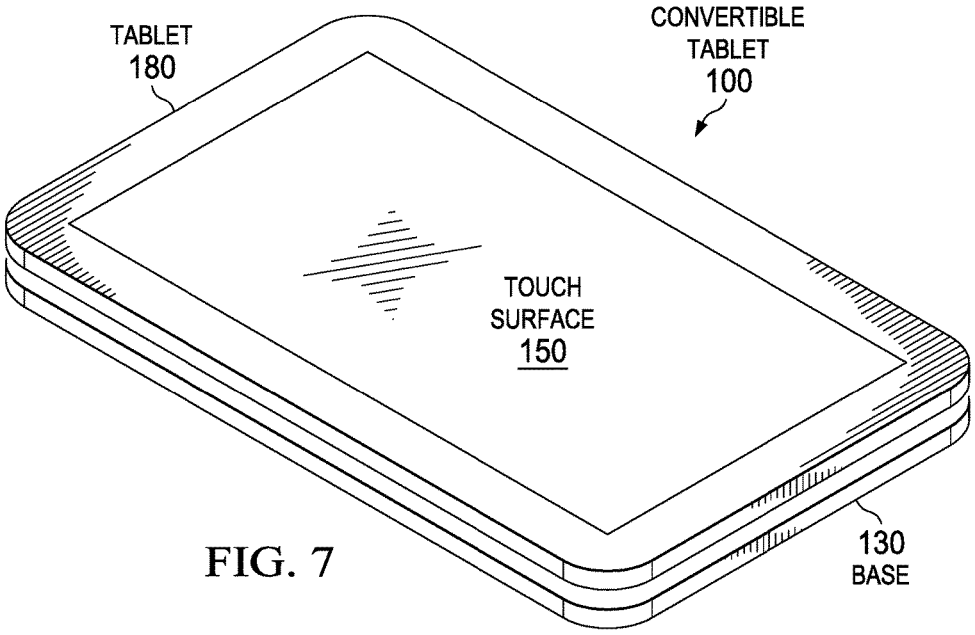
FIG. 7 is a perspective view of a convertible tablet according to one or more examples of the present specification.

Such a configuration is shown in FIG. 7, which is yet another perspective view of convertible tablet 100 according to one or more examples of the present Specification. As can be seen in this embodiment, tablet 180 has been rotated so that it is substantially back-to-back with base 130.

Figure 8:
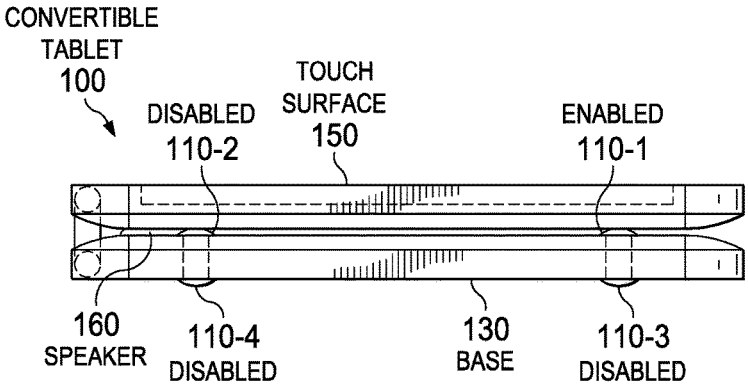
FIG. 8 is a side view of a convertible tablet according to one or more examples of the present specification.

As is disclosed with more particularity in FIG. 8, in this configuration, top mechanical drivers 110-1 and 110-2 of base 130 abut the back of tablet 180. Bottom mechanical drivers 110-3 and 110-4 may either be in open air, or may rest on work surface 140. In an example where convertible tablet 100 is held in the open air, bottom mechanical drivers 110-3 and 110-4 may be disabled as they have no mechanical mass against which to drive an acoustic signal. Similarly, mechanical driver 110-2 may also be disabled because, although it is resting against the back of tablet 180, in one example, rear bottom driver 110-2 sits too close to speaker 160, and thus may cause distortion, interference, or other problems. Thus, in the embodiment of FIG. 8, only front bottom driver 110-1 is enabled.

Figure 9A:
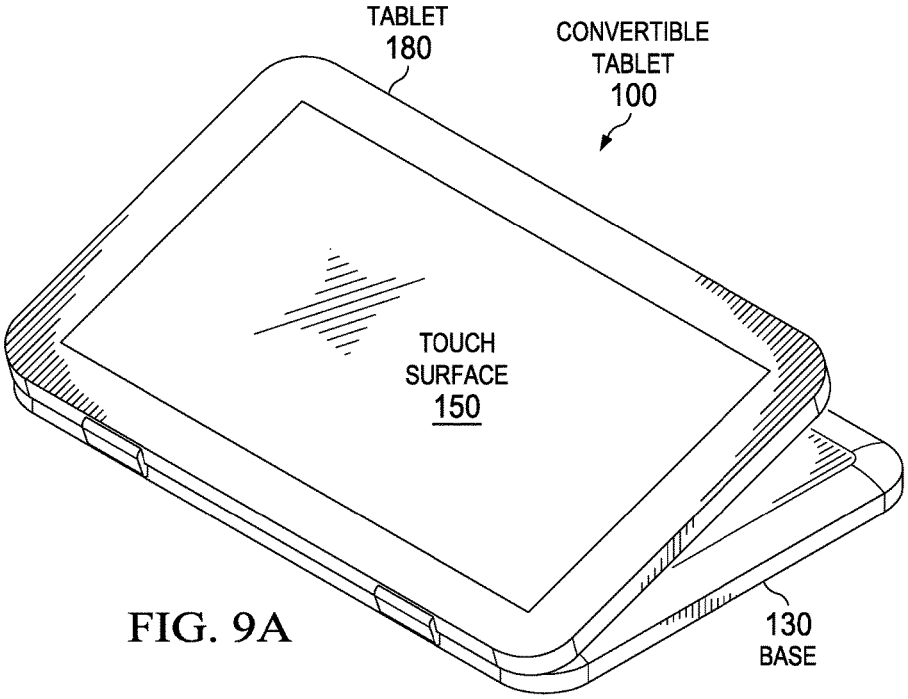
FIG. 9A is a perspective view of a convertible tablet according to one or more examples of the present specification.

FIG. 9A is yet another perspective view of convertible tablet 100 according to one or more examples of the present Specification. In this example, tablet 180 may be rotated through approximately 100 to 320° of rotation, so that base 130 may rest facedown on work surface 140, and tablet 180 may sit propped against base 130. This can be seen with more particularity in FIG. 9B, which is a side view of the embodiment of FIG. 9A.

Figure 9B:
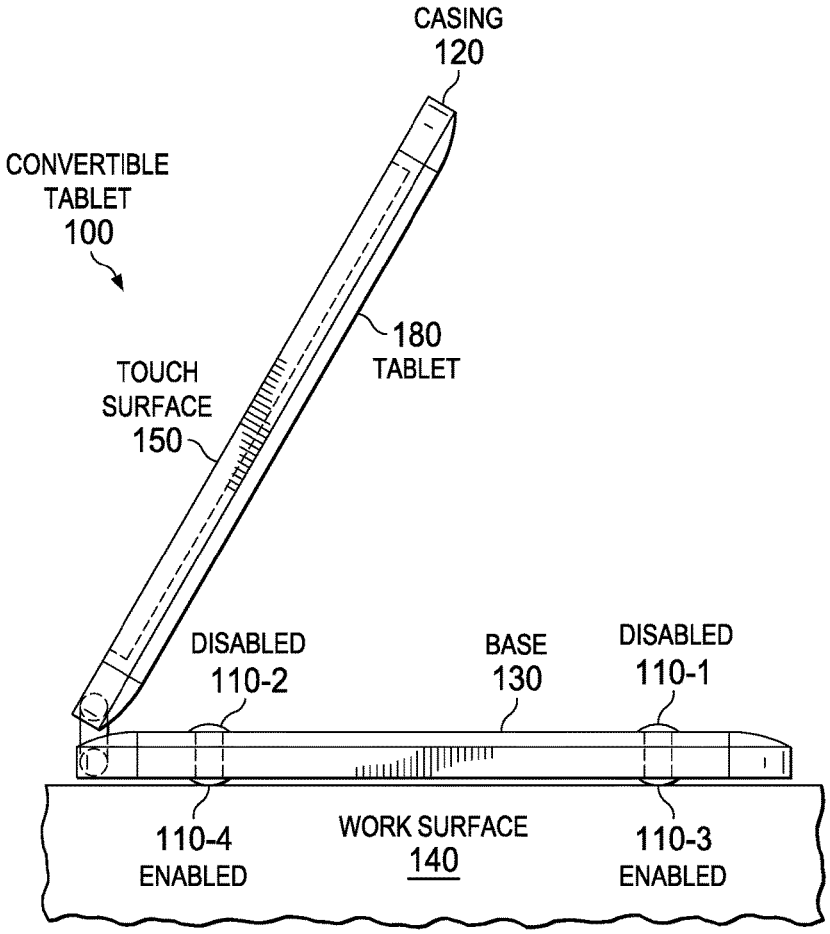
FIG. 9B is a perspective view of a convertible tablet according to one or more examples of the present specification.

As seen in FIG. 9B, front bottom mechanical driver 110-1 and rear bottom mechanical driver 110-2 have no mechanical surface resting against them, and thus are unable to drive an acoustic signal. In this case, bottom mechanical drivers are disabled. However, this configuration may commonly be used in a situation where user 410 of FIG. 4 places convertible tablet 100 on work surface 140 for viewing and interaction. Thus, top drivers 110-3 and 110-4 may be enabled, and may drive an acoustic waveform onto work surface 140.

Figure 10:
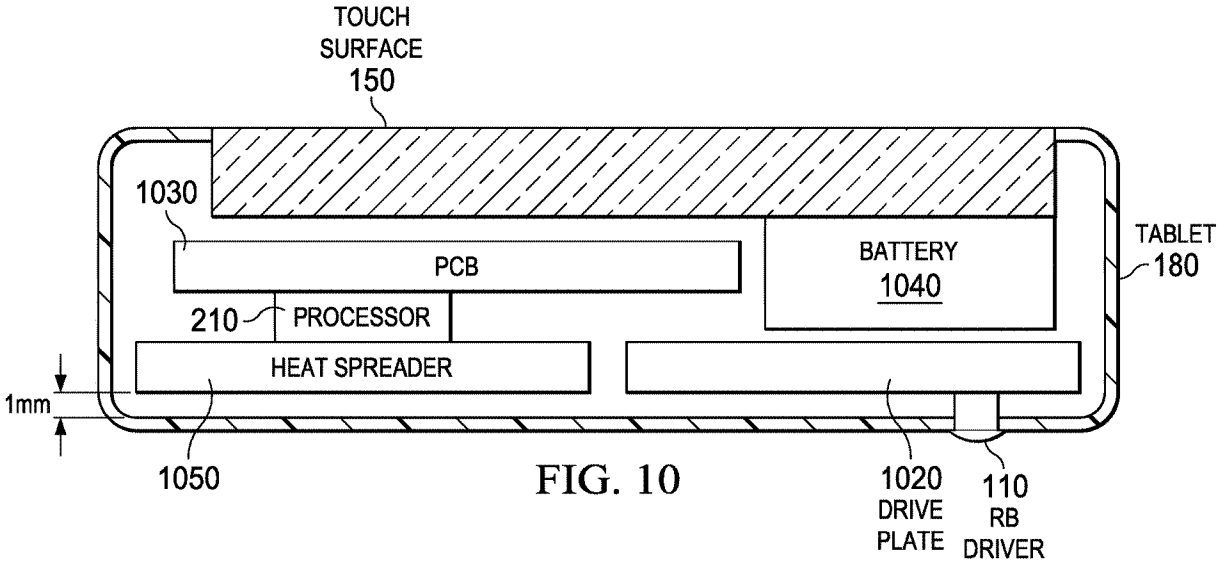
FIG. 10 is a cutaway side view of selected elements of a convertible tablet according to one or more examples of the present specification.

FIG. 10 is a cutaway side view of a convertible tablet 100 according to one or more examples of the present Specification. In the example of FIG. 10, selected internal structures of convertible tablet 100 are visible. Specifically, processor 210 is visible in addition to a printed circuit board (PCB) 1030, heat spreader 1050, and battery 1040. Touch screen 150 is placed above these. Also visible in this example is a drive plate 1020, disposed above a mechanical driver 110 and mechanically coupled thereto. In this configuration, drive plate 1020 may provide a supplemental drive surface for mechanical driver 110. Thus, in certain embodiments, mechanical driver 110 may be operable even if no working surface 140 is provided. In other embodiments, drive plate 1020 is provided as a supplemental drive surface to working surface 140.

Figure 11:
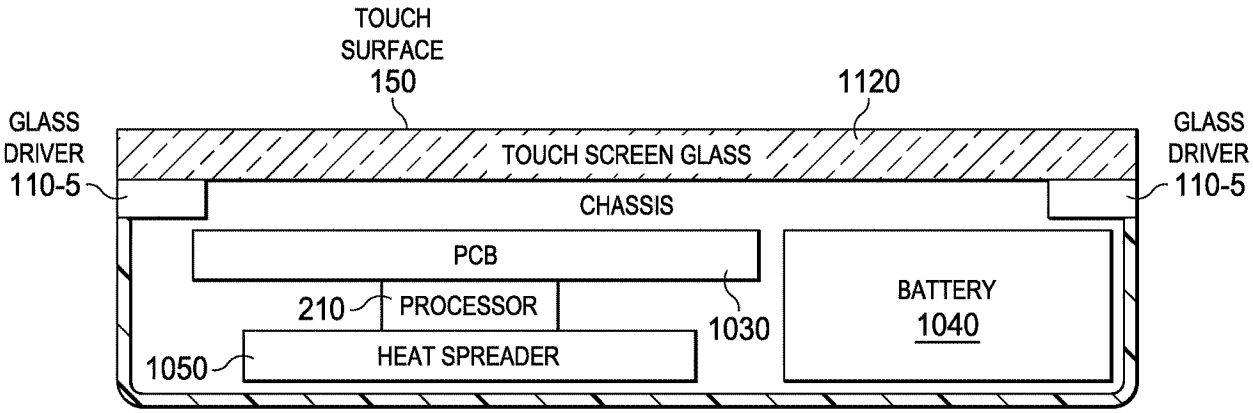
FIG. 11 is a cutaway side view of selected elements of a convertible tablet according to one or more examples of the present specification.

FIG. 11 is another cutaway side view of convertible tablet 100 according to one or more examples of the present Specification. In this example, once again processor 210 is visible, in addition to PCB 1030, heat spreader 1050, and battery 1040. Touch screen 150 is disposed at the top of convertible tablet 100. A new species of mechanical driver 110 is also disclosed in FIG. 11, namely glass driver 110-5. Glass drivers 110-5 may be placed below touch screen glass 1120 of touch screen 150 and may be mechanically coupled thereto, and are operable to use touch screen glass 1120 as a drive surface. Glass drivers 110-5 may be configured to be continuously enabled, or to be at least continuously available, regardless of the presence of a working surface 140. It should be noted, however, that method 1200 of FIG. 12 may be used in some cases to determine whether glass drivers 110-5 are negatively affecting system performance.

FIG. 12 is a flow diagram of a method 1200 for calibrating an audio subsystem 280 according to one or more examples of the present Specification, which may for example be carried out by an audio monitoring program as described herein. Flow diagrams as illustrated herein provide examples of sequences of various process actions. Although shown in a particular sequence or order, unless otherwise specified, the order of the actions may be modified. It should also be understood that the steps disclosed herein are provided by way of example only, and that certain disclosed steps may be omitted in various embodiments.

In block 1210, processor 210 (FIG. 2) may use sensors and monitors to determine an operational context for convertible tablet 100. The system context may describe a particular manner in which user 410 is operating convertible tablet 100, and may include information about whether tablet 180 is attached to base 130, and whether tablet 180 has been rotated or otherwise moved. The operational context of block 1210 may also include an enumeration of running programs, and an analysis of whether any of the programs require lower-frequency audio capabilities. If the usage context of block 1210 does not include any lower-frequency audio components, or is otherwise unsuitable for augmenting speakers 160, for example because convertible tablet 100 is being used in a configuration or positions where no drive surfaces are available for mechanical drivers 110, then control passes to block 1280 in which processor 210 disables all mechanical drivers, and in block 1290 the method is done.

In block 1220, audio subsystem 280 (FIG. 2) may be calibrated by outputting audio data at different frequencies at various amplification levels.

In block 1230, an accelerometer or other suitable transducer or sensor may be used to measure the effect of mechanical drivers 110 to determine if system vibration is adversely affecting convertible tablet 100. For example, a strong vibration may affect the clarity of viewing a display on touch surface 150, depending for example on the placement of the device and the nature of work surface 140. If mechanical drivers 110 are unacceptably negatively affecting system performance, then control passes to block 1280, in which processor 210 disables all mechanical drivers, and in block 1290, the method is done.

Returning to block 1230, if there is no adverse system effect, then in block 1240 one or more mechanical drivers 110 are selected for providing augmented audio. Mechanical drivers 110 may be selected according to any suitable scheme, including according to the schemes disclosed throughout the preceding FIGURES.

In block 1250, processor 210 may collect feedback data from an audio sensor that is part of audio subsystem 280. The audio sensor may include, for example, a microphone or other transducer. As the audio data at various frequencies may vary based on the environment surrounding the device, block 1250 provides a critical performance improvement.

In block 1260, processor 210 may use feedback from block 1250 to determine a maximum amplification threshold (e.g., resonance frequencies), as well as adjust additional equalization settings (e.g., vibration oscillation factors).

In block 1290, the method is done.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The particular embodiments of the present disclosure may readily include a system on chip (SOC) central processing unit (CPU) package. An SOC represents an integrated circuit (IC) that integrates components of a computer or other electronic system into a single chip. It may contain digital, analog, mixed-signal, and radio frequency functions; all of which may be provided on a single chip substrate. Other embodiments may include a multi-chip-module (MCM), with a plurality of chips located within a single electronic package and configured to interact closely with each other through the electronic package. In various other embodiments, the digital signal processing functionalities may be implemented in one or more silicon cores in Application Specific Integrated Circuits (ASICs), Field Programmable Gate Arrays (FPGAs), and other semiconductor chips.

In example implementations, at least some portions of the processing activities outlined herein may also be implemented in software. In some embodiments, one or more of these features may be implemented in hardware provided external to the elements of the disclosed FIGURES, or consolidated in any appropriate manner to achieve the intended functionality. The various components may include software (or reciprocating software) that can coordinate in order to achieve the operations as outlined herein. In still other embodiments, these elements may include any suitable algorithms, hardware, software, components, modules, interfaces, or objects that facilitate the operations thereof.

Additionally, some of the components associated with described microprocessors may be removed, or otherwise consolidated. In a general sense, the arrangements depicted in the FIGURES may be more logical in their representations, whereas the physical architecture may include various permutations, combinations, and/or hybrids of these elements. It is imperative to note that countless possible design configurations can be used to achieve the operational objectives outlined herein. Accordingly, the associated infrastructure has a myriad of substitute arrangements, design choices, device possibilities, hardware configurations, software implementations, equipment options, etc.

Any suitably-configured processor component can execute any type of instructions associated with the data to achieve the operations detailed herein. Any processor disclosed herein could transform an element or an article (for example, data) from one state or thing to another state or thing. In another example, some activities outlined herein may be implemented with fixed logic or programmable logic (for example, software and/or computer instructions executed by a processor) and the elements identified herein could be some type of a programmable processor, programmable digital logic, for example, an FPGA, an erasable programmable read only memory (EPROM), an electrically erasable programmable read only memory (EEPROM)), an ASIC that includes digital logic, software, code, electronic instructions, flash memory, optical disks, CD-ROMs, DVD ROMs, magnetic or optical cards, other types of machine-readable mediums suitable for storing electronic instructions, or any suitable combination thereof. In operation, processors may store information in any suitable type of non-transitory storage medium (for example, random access memory (RAM), read only memory (ROM), FPGA, EPROM, EEPROM, etc.), software, hardware, or in any other suitable component, device, element, or object where appropriate and based on particular needs. Further, the information being tracked, sent, received, or stored in a processor could be provided in any database, register, table, cache, queue, control list, or storage structure, based on particular needs and implementations, all of which could be referenced in any suitable timeframe. Any of the memory items discussed herein should be construed as being encompassed within the broad term 'memory.' Similarly, any of the potential processing elements, modules, and machines described herein should be construed as being encompassed within the broad term 'microprocessor' or 'processor.' Furthermore, in various embodiments, the processors, memories, network cards, buses, storage devices, related peripherals, and other hardware elements described herein may be realized by a processor, memory, and other related devices configured by software or firmware to emulate or virtualize the functions of those hardware elements.

Computer program logic implementing all or part of the functionality described herein is embodied in various forms, including, but in no way limited to, a source code form, a computer executable form, and various intermediate forms (for example, forms generated by an assembler, compiler, linker, or locator). In an example, source code includes a series of computer program instructions implemented in various programming languages, such as an object code, an assembly language, or a high-level language such as OpenCL, Fortran, C, C++, JAVA, or HTML for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

In the discussions of the embodiments above, the capacitors, buffers, graphics elements, interconnect boards, clocks, DDRs, camera sensors, dividers, inductors, resistors, amplifiers, switches, digital core, transistors, and/or other components can readily be replaced, substituted, or otherwise modified in order to accommodate particular circuitry needs. Moreover, it should be noted that the use of complementary electronic devices, hardware, non-transitory software, etc. offer an equally viable option for implementing the teachings of the present disclosure.

In one example embodiment, any number of electrical circuits of the FIGURES may be implemented on a board of an associated electronic device. The board can be a general circuit board that can hold various components of the internal electronic system of the electronic device and, further, provide connectors for other peripherals. More specifically, the board can provide the electrical connections by which the other components of the system can communicate electrically. Any suitable processors (inclusive of digital signal processors, microprocessors, supporting chipsets, etc.), memory elements, etc. can be suitably coupled to the board based on particular configuration needs, processing demands, computer designs, etc. Other components such as external storage, additional sensors, controllers for audio/video display, and peripheral devices may be attached to the board as plug-in cards, via cables, or integrated into the board itself. In another example embodiment, the electrical circuits of the FIGURES may be implemented as stand-alone modules (e.g., a device with associated components and circuitry configured to perform a specific application or function) or implemented as plug-in modules into application specific hardware of electronic devices.

Note that with the numerous examples provided herein, interaction may be described in terms of two, three, four, or more electrical components. However, this has been done for purposes of clarity and example only. It should be appreciated that the system can be consolidated in any suitable manner. Along similar design alternatives, any of the illustrated components, modules, and elements of the FIGURES may be combined in various possible configurations, all of which are clearly within the broad scope of this Specification. In certain cases, it may be easier to describe one or more of the functionalities of a given set of flows by only referencing a limited number of electrical elements. It should be appreciated that the electrical circuits of the FIGURES and its teachings are readily scalable and can accommodate a large number of components, as well as more complicated/sophisticated arrangements and configurations. Accordingly, the examples provided should not limit the scope or inhibit the broad teachings of the electrical circuits as potentially applied to a myriad of other architectures.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "steps for" are specifically used in the particular claims; and (b) does not intend, by any statement in the specification, to limit this disclosure in any way that is not otherwise reflected in the appended claims.

Example Embodiment Implementations

There is disclosed in an example 1, an apparatus comprising:

a plurality of mechanical drivers of at least two species, wherein a first species comprises a top mechanical driver and a second species comprises a bottom mechanical driver, and wherein the mechanical drivers are operable to drive a low-frequency acoustic waveform onto a drive surface.

There is disclosed in an example 2, the apparatus of example 1, wherein a mechanical driver of the first species is disposed substantially above a mechanical driver of the second species, and wherein at least one of the mechanical drivers is operable to provide a waveform to cancel a feedback of the other mechanical driver.

There is disclosed in an example 3, the apparatus of example 1, further comprising logic, at least partly implemented in hardware, to enable mechanical drivers disposed against an external drive surface.

There is disclosed in an example 4, the apparatus of example 1, further comprising logic, at least partly implemented in hardware, to enable mechanical drivers disposed against a surface of a computing device housing the apparatus.

There is disclosed in an example 5, the apparatus of example 1, further comprising a drive plate disposed against at least one of the mechanical drivers and configured to act as a drive surface when the mechanical driver outputs an acoustic waveform.

There is disclosed in an example 6, the apparatus of example 1, further comprising logic, at least partly implemented in hardware, to calibrate the mechanical drivers by determining whether audio enhancement by use of the mechanical drivers is suitable for a usage context.

There is disclosed in an example 7, the apparatus of example 6, further comprising logic, at least partly implemented in hardware, to select one or more of the mechanical drivers for use in the usage context.

There is disclosed in an example 8, the apparatus of example 7, wherein selecting one or more of the mechanical drivers comprises selecting drivers disposed against an external drive surface.

There is disclosed in an example 9, the apparatus of example 7, wherein selecting one or more of the mechanical drivers comprises sensing a position of a first housing of a computing device relative to a second housing of the computing device.

There is disclosed in an example 10, the apparatus of example 7, wherein selecting one or more of the mechanical drivers comprises sensing a position of a flip stand of a computing device.

There is disclosed in an example 11, the apparatus of example 7, wherein selecting one or more of the mechanical drivers comprises selecting a mechanical driver disposed against a rigid display surface of a computing device.

There is disclosed in an example 12, a system comprising:

a computing device; and an audio subsystem comprising a speaker and a plurality of mechanical drivers of at least two species disposed within a housing of the computing system, wherein a first species comprises a top mechanical driver and a second species comprises a bottom mechanical driver, and wherein the mechanical drivers are operable to drive a low-frequency acoustic waveform onto a drive surface.

There is disclosed in an example 13, the system of example 12, wherein a mechanical driver of the first species is disposed substantially above a mechanical driver of the second species, and wherein at least one of the mechanical drivers is operable to provide a waveform to cancel a feedback of the other mechanical driver.

There is disclosed in an example 14, the system of example 12, further comprising logic, at least partly implemented in hardware, to enable mechanical drivers disposed against an external drive surface.

There is disclosed in an example 15, the system of example 12, further comprising logic, at least partly implemented in hardware, to enable mechanical drivers disposed against a surface of a computing device housing the apparatus.

There is disclosed in an example 16, the system of example 12, further comprising a drive plate disposed against at least one of the mechanical drivers and configured to act as a drive surface when the mechanical driver outputs an acoustic waveform.

There is disclosed in an example 17, there is disclosed in an example 16, the system of example 12, further comprising logic, at least partly implemented in hardware, to calibrate the mechanical drivers by determining whether audio enhancement by use of the mechanical drivers is suitable for a usage context.

There is disclosed in an example 19, the system of example 17, further comprising logic, at least partly implemented in hardware, to select one or more of the mechanical drivers for use in the usage context.

There is disclosed in an example 20, the system of example 18, wherein selecting one or more of the mechanical drivers comprises selecting drivers disposed against an external drive surface.

There is disclosed in an example 21, the system of example 18, wherein selecting one or more of the mechanical drivers comprises sensing a position of a first housing of the computing device relative to a second housing of the computing device.

There is disclosed in an example 22, the system of example 18, wherein selecting one or more of the mechanical drivers comprises sensing a position of a flip stand of the computing device.

There is disclosed in an example 23, the system of example 18, wherein selecting one or more of the mechanical drivers comprises selecting a mechanical driver disposed against a rigid display surface of the computing device.

There is disclosed in an example 24, a method comprising:

selecting at least one mechanical driver for driving against a drive surface from a plurality of mechanical drivers of at least two species, based on a usage context of a computing device.

There is disclosed in an example 25, the method of example 24, wherein selecting one or more of the mechanical drivers comprises selecting drivers disposed against an external drive surface.

There is disclosed in an example 26, the method of example 24, wherein selecting one or more of the mechanical drivers comprises sensing a position of a first housing of a computing device relative to a second housing of the computing device.

There is disclosed in an example 27, the method of example 24, wherein selecting one or more of the mechanical drivers comprises sensing a position of a flip stand of a computing device.

There is disclosed in an example 28, the method of example 24, wherein selecting one or more of the mechanical drivers comprises selecting a mechanical driver disposed against a rigid display surface of the computing device.

What is claimed is:

1. An apparatus comprising:

a foldable structural casement comprising a first planar surface having a first plurality of feet and a second planar surface removed from the first planar surface, the second planar surface having a second plurality of feet; and a first mechanical driver disposed within one of the first plurality of feet, and a second mechanical driver disposed within one of the second plurality of feet; and a sensor to detect that the foldable structural casement is in a folded configuration, wherein the first plurality of feet abut a third planar surface of the foldable structure;

wherein the first mechanical driver is configured to drive a low-frequency audio waveform onto the third planar surface of the structural casement in the folded configuration.

2. The apparatus of claim 1, wherein the second mechanical driver is configured to provide an audio waveform to cancel feedback of the first mechanical driver while the structural casement is in the folded configuration.

3. The apparatus of claim 1, further comprising logic, at least partly implemented in hardware, to provide an enable signal to determine that one of the first mechanical driver or second mechanical driver abuts a work surface, and provide an enable signal to the mechanical driver abutting the work surface.

4. The apparatus of claim 1, further comprising logic, at least partly implemented in hardware, to determine that one of the first mechanical driver or second mechanical driver abuts a planar surface of a mechanical housing, and provide an enable signal to the mechanical driver abutting the planar surface.

5. The apparatus of claim 1, further comprising a drive plate disposed internal to the mechanical housing and against at least one of the mechanical drivers and configured to act as a drive surface when the mechanical driver outputs an audio waveform.

6. The apparatus of claim 1, further comprising logic, at least partly implemented in hardware, to calibrate the mechanical drivers by determining whether audio enhancement by use of the mechanical drivers is suitable for a usage context.

7. The apparatus of claim 6, further comprising logic, at least partly implemented in hardware, to select one or more of the mechanical drivers for use in the usage context.

8. The apparatus of claim 7 wherein selecting one or more of the mechanical drivers comprises selecting drivers disposed against an external drive surface.

9. The apparatus of claim 7, wherein selecting one or more of the mechanical drivers comprises sensing a position of a first housing of a computing device relative to a second housing of the computing device.

10. The apparatus of claim 7, wherein selecting one or more of the mechanical drivers comprises sensing a position of a flip stand of a computing device.

11. The apparatus of claim 7, wherein selecting one or more of the mechanical drivers comprises selecting a mechanical driver disposed against a rigid display surface of a computing device.

12. A system comprising:

a computing device; and an audio subsystem comprising a speaker and a foldable structural casement comprising a first planar surface having a first plurality of feet and a second planar surface removed from the first planar surface, the second planar surface having a second plurality of feet; and a first mechanical driver disposed within one of the first plurality of feet, and a second mechanical driver disposed within one of the second plurality of feet; and a sensor to detect that the foldable structural casement is in a folded configuration, wherein the first plurality of feet abut a third planar surface of the foldable structure;

wherein the first mechanical driver is configured to drive a low-frequency audio waveform onto the third planar surface of the structural casement in the folded configuration.

13. The system of claim 12, wherein the second mechanical driver is configured to provide an audio waveform to cancel feedback of the first mechanical driver while the structural casement is in the folded configuration.

14. The system of claim 12, further comprising logic, at least partly implemented in hardware, to provide an enable signal to determine that one of the first mechanical driver or second mechanical driver abuts a work surface, and provide an enable signal to the mechanical driver abutting the work surface.

15. The system of claim 12, further comprising logic, at least partly implemented in hardware, to determine that one of the first mechanical driver or second mechanical driver abuts a planar surface of a mechanical housing, and provide an enable signal to the mechanical driver abutting the planar surface.

16. The system of claim 12, further comprising a drive plate disposed internal to the mechanical housing and against at least one of the mechanical drivers and configured to act as a drive surface when the mechanical driver outputs an audio waveform.

17. The system of claim 12, further comprising logic, at least partly implemented in hardware, to calibrate the mechanical drivers by determining whether audio enhancement by use of the mechanical drivers is suitable for a usage context.

18. The system of claim 17, further comprising logic, at least partly implemented in hardware, to select one or more of the mechanical drivers for use in the usage context.

19. The system of claim 18, wherein selecting one or more of the mechanical drivers comprises selecting drivers disposed against an external drive surface.

20. The system of claim 18, wherein selecting one or more of the mechanical drivers comprises sensing a position of a first housing of the computing device relative to a second housing of the computing device.

21. The system of claim 18, wherein selecting one or more of the mechanical drivers comprises sensing a position of a flip stand of the computing device.

22. The system of claim 18, wherein selecting one or more of the mechanical drivers comprises selecting a mechanical driver disposed against a rigid display surface of the computing device.

23. A method comprising:

detecting that a foldable structural casement comprising a first planar surface having a first plurality of feet and a second planar surface removed from the first planar surface, the second planar surface having a second plurality of feet is in a folded configuration, wherein the first plurality of feet abut a third planar surface of the foldable structure, wherein a mechanical driver is one of at least two species of mechanical driver of an apparatus; and driving a low-frequency audio waveform onto the third planar surface of the folded structural casement.

24. The method of claim 23, wherein the mechanical driver is disposed to abut an external surface when the foldable structural casement is in an unfolded configuration.

25. The method of claim 23, wherein detecting that the foldable structural casement is in a folded configuration comprises sensing a position of a first housing of a computing device relative to a second housing of the computing device.

26. The method of claim 23, wherein detecting that the foldable structural casement is in a folded configuration comprises sensing a position of a flip stand of a computing device.

27. The method of claim 23, wherein a planar surface of the foldable structural casement is a rigid display surface of the apparatus.

* * * * *